US012305480B2

(12) United States Patent
Hall-Thompson et al.

(10) Patent No.: US 12,305,480 B2
(45) Date of Patent: May 20, 2025

(54) PRODUCING GAS THROUGH VARIABLE BORE PRODUCTION TUBING

(71) Applicant: Saudi Arabian Oil Company, Dhahran (SA)

(72) Inventors: Bryan Hall-Thompson, Dhahran (SA); Oladele Owoeye, Dhahran (SA); Abdulrahman Nutaifi, Dhahran (SA); Olaoluwa S. Salako, Dhahran (SA); Ghadeer A. Alrumaih, Saihat (SA)

(73) Assignee: Saudi Arabian Oil Company, Dhahran (SA)

( * ) Notice: Subject to any disclaimer, the term of this patent is extended or adjusted under 35 U.S.C. 154(b) by 87 days.

(21) Appl. No.: 17/804,764

(22) Filed: May 31, 2022

(65) Prior Publication Data

US 2023/0383621 A1 Nov. 30, 2023

(51) Int. Cl.
*E21B 34/12* (2006.01)
*E21B 17/02* (2006.01)

(52) U.S. Cl.
CPC ..... *E21B 34/12* (2013.01); *E21B 17/02* (2013.01)

(58) Field of Classification Search
CPC ..... E21B 17/02; E21B 17/041
See application file for complete search history.

(56) References Cited

U.S. PATENT DOCUMENTS 3,477,506 A 11/1969 Malone
6,244,631 B1 * 6/2001 Payne ..... F16L 15/001 285/333
6,681,862 B2 1/2004 Freeman
6,719,064 B2 4/2004 Price-Smith et al.
6,766,862 B2 7/2004 Chatterji et al.
6,789,621 B2 9/2004 Wetzel et al.
6,832,649 B2 12/2004 Bode et al.
6,902,000 B2 6/2005 Simpson et al.
6,978,840 B2 12/2005 Henderson
7,044,218 B2 5/2006 Cook et al.
7,073,599 B2 7/2006 Smith
7,156,179 B2 1/2007 Harall et al.
7,159,665 B2 1/2007 Cook et al.
(Continued)

FOREIGN PATENT DOCUMENTS

AU 2004263549 2/2005
AU 2013200438 4/2013
(Continued)

OTHER PUBLICATIONS

Akbar et al., "The Successful Planning and Implementation of High Angle Deviated HPHT Well Testing in the Sour Naturally Fractured Gas Reservoir: Case Study of S-3 Well," SPE-146978-MS, presented SPE Asia Pacific Oil and Gas Conference and Exhibition, Jakarta, Indonesia, Sep. 2011, 13 pages.
(Continued)

*Primary Examiner* — Kristyn A Hall
(74) *Attorney, Agent, or Firm* — Fish & Richardson P.C.

(57) ABSTRACT

An uphole section has a first diameter. A midhole section has a second diameter that is larger than the first diameter. The midhole section is attached to the uphole section prior to installation into a wellbore. A downhole section has a third diameter that is smaller than the second diameter. The downhole section is attached to the midhole section prior to installation into the wellbore.

19 Claims, 2 Drawing Sheets

(56) References Cited

U.S. PATENT DOCUMENTS

| | | | | |
|---|---|---|---|---|
| 7,369,979 | B1 | 5/2008 | Spivey et al. | |
| 7,380,609 | B2 | 6/2008 | Page et al. | |
| 8,011,446 | B2 | 9/2011 | Wylie et al. | |
| 8,356,668 | B2 | 1/2013 | Dykstra et al. | |
| 9,506,320 | B2 | 11/2016 | Dykstra et al. | |
| 9,574,406 | B2 | 2/2017 | Davis et al. | |
| 9,617,833 | B2 | 4/2017 | Madasu et al. | |
| 2004/0200618 | A1* | 10/2004 | Piekenbrock | E21B 41/0064 166/305.1 |
| 2010/0108315 | A1* | 5/2010 | Stevens | C09K 8/52 166/268 |
| 2010/0200233 | A1* | 8/2010 | Yeh | E21B 43/082 166/278 |
| 2015/0306703 | A1* | 10/2015 | Hamre | E21B 17/1085 219/121.64 |
| 2019/0330929 | A1* | 10/2019 | Breen | E21B 17/08 |
| 2020/0024938 | A1 | 1/2020 | Fry | |
| 2020/0056276 | A1* | 2/2020 | Scott | C22C 38/50 |
| 2022/0113446 | A1 | 4/2022 | Hall-Thompson et al. | |

FOREIGN PATENT DOCUMENTS

| | | |
|---|---|---|
| AU | 2019201431 | 3/2019 |
| CA | 2452857 | 6/2003 |
| EP | 1497530 | 1/2005 |
| EP | 1588015 | 10/2005 |
| EP | 1702133 | 9/2006 |

OTHER PUBLICATIONS

Al-Baqawi et al., "Optimizing Offshore Gas Field Development with Large Well Bore Completion," IPTC-16626-MS, presented at the International Petroleum Technology Conference, Beijing, China, Mar. 2013, 8 pages.

Ali et al., "Qualification Testing of Large Bore, HP Tubing Retrievable Safety Valves for Gas Wells," SPE 16576, presented at the International Petroleum Technology Conference, Beijing, China, Mar. 2013, 13 pages.

Baghdadi et al., "Development of Sand Erosion and Transport Software for Efficient Sand Management," OTC 26488, presented at the Offshore Technology Conference Asia, Kuala Lumpur, Malaysia, Mar. 2016, 19 pages.

Boyer et al., "Production Array Logs in Bakken Horizontal Shale Play Reveal Unique Performance Based on Completion Technique," SPE-160160-MS, presented at the SPE Annual Technical Conference and Exhibition, San Antonio, Texas, Oct. 2012, 14 pages.

Bybee, "Integrated Approach to Optimize Material Selection for High-Rate Gas Wells," Journal of Petroleum Technology, May 2009, 61(05):87-88, 2 pages.

Carpenter, "Optimizing the Deepwater Completion Process Offshore Israel," Journal of Petroleum Technology, Sep. 2018, 70(09):96-97, 2 pages.

Clancey et al., "Drilling & Completion Technology Solutions for Challenging North Field Operations," IPTC-13421-MS, presented at the International Petroleum Technology Conference, Doha, Qatar, Dec. 2009, 10 pages.

Clancey et al., "Optimized Big Bore Gas Wells for Qatar North Field," IPTC-12458-MS, presented at the International Petroleum Technology Conference, Kuala Lumpur, Malaysia, Dec. 2008, 11 pages.

Cooper et al., "A Critical Review of Completion Techniques for High-Rate Gas Wells Offshore Trinidad," SPE-106854-MS, presented at the European Formation Damage Conference, Scheveningen, The Netherlands, May 30-Jun. 1, 2007, 9 pages.

Dolan et al., "Planning and Execution of Big Bore Wells—Offshore NW Australia," SPE 67820, presented at the SPE/IADC Drilling Conference, Amsterdam, The Netherlands, Feb. 27-Mar. 1, 2001, 9 pages.

Golder, "Sakhalin II Project Overview," OTC-10815-MS, presented at the Offshore Technology Conference, Houston, Texas, May 1999, 7 pages.

Gunningham et al., "The Integrated Use of New Technology in the Development of the Sakhalin II Project," SPE-114805-MS, presented at the SPE Russian Oil & Gas Technical Conference and Exhibition, Moscow, Russia, Oct. 2008, 12 pages.

Hartmann et al., "Big bore, high flowrate, deep water gas wells for Ormen Lange," OTC 16554, presented at the Offshore Technology Conference, May 2004, 8 pages.

Haugen et al., "Development of a Large Deep-Water Gas Field in Tanzania: Subsurface Challenges and Solutions in a Frontier Area Einar Haugen," SPE 191763, presented at the SPE Annual Technical Conference and Exhibition, Dallas, Texas, Sep. 2018, 14 pages.

Healy et al., "Completion Design, Installation, and Performance—Cannonball Field, Offshore Trinidad," SPE 110524-PP, presented at the SPE Annual Technical Conference and Exhibition, Anaheim, California, Nov. 2007, 23 pages.

Healy et al., "Completion Design, Installation, and Performance—Cannonball Field, Offshore Trinidad," SPE Drilling and Completion, Dec. 2009, 626-641, 16 pages.

Healy et al., "Design, Installation, and Initial Performance of Ultra-High-Rate Gas Deepwater Completions—Tamar Field, Offshore Israel," SPE 166368, presented at the SPE Annual Technical Conference and Exhibition, New Orleans, Louisiana, Sep. 30-Oct. 2, 2013, 22 pages.

Healy et al., "Design, Installation, and Performance of Big Bore (9-5/8 in.) Completions: Mari-B Field, Offshore Israel," SPE 151770, presented at the SPE International Symposium and Exhibition on Formation Damage Control, Lafayette, Louisiana, Feb. 2012, 20 pages.

Healy et al., "Erosion Study for a 400 MMcf/D Completion: Cannonball Field, Offshore Trinidad," SPE-115546-MS, presented at the SPE Annual Technical Conference and Exhibition, Denver, Colorado, Sep. 2008, 16 pages.

Healy et al., "Optimizing the Deepwater Completion Process: Case History of the Tamar 8 Completion Design, Execution and Initial Performance—Offshore Israel," SPE-189637-MS, presented at the IADC/SPE Drilling Conference and Exhibition, Fort Worth, Texas, Mar. 2018, 18 pages.

Husein, "High Temperature High Rate Gas Well Completions: A Learning Experience," SPE-17665-MS, presented at the 7th Offshore South East Asia Conference, Singapore, Feb. 1988, 12 pages.

JPT staff, "Design of High-Rate Gas Wells: Issues and Solutions," Journal of Petroleum Technology, Apr. 1999, 51(04):96-97, 2 pages.

Kromah et al., "Trinidad's First 500Mmcfd well: Fact or Fiction?" SPE 810145, presented at the SPE Latin American and Caribbean Petroleum Engineering Conference, Port-of-Spain, Trinidad, West Indies, Apr. 2003, 9 pages.

Ledlow et al., "Revised Big-Bore Well Design Recovers Original Bayu Undan Production Targets," SPE 114011, presented at the SPE Annual Technical Conference and Exhibition, Denver, Colorado, Sep. 2008, 14 pages.

Martin et al., "Design and Operations Guidelines to Avoid Erosion Problems in Oil and Gas Production Systems—One Operator's Approach," NACE-06592, Corrosion NaceExpo, 61st Annual Conference and Exhibition, 2006, 10 pages.

Park et al., "A Case Study on the Shwe Gas Field Development Completion in Myanmar—From Design to Installation," presented at the International Petroleum Technology Conference, Bangkok, Thailand, Nov. 2016, 21 pages.

Reeves et al., "One Tcf From One Well: The Design of a 500 MMscf/D Subsea Well for Offshore Mega Gas Fields," SPE 168118, presented at the SPE International Symposium and Exhibition on Formation Damage Control, Lafayette, Louisiana, Feb. 2014, 20 pages.

Sanford et al., "Pushing the Completion Design Envelope in Ultra-Deepwater—Design, Installation, and Performance of Deep High Pressure Completions—A Case History of the Gunflint Development, Offshore Gulf of Mexico," SPE 181557, presented at the SPE Annual Technical Conference and Exhibition, Dubai, UAE, Sep. 2016, 26 pages.

(56) References Cited

OTHER PUBLICATIONS

Sehnal et al., "Collaborative Effort Enables Repair of Prolific Gas Well With Solid Expandable Chrome Liner," OTC-19657-MS, presented at the Offshore Technology Conference, Houston, Texas, May 2008, 19 pages.
Sorem et al., "Integrated Approach to Optimise Material Selection for North Field High-Rate Gas Wells," presented at the International Petroleum Technology Conference, Kuala Lumpur, Malaysia, Dec. 2008, 17 pages.
Sun et al., "Integrated Approach to Quantify L80 Tubing Corrosion for High-rate Sour Gas Wells," presented at the International Petroleum Technical Conference, Bangkok, Thailand, Feb. 2012, 8 pages.
Teng et al., "High Rate Gas Well Design: Issues and Solutions—Goodwyn Gas Condensate, NWS, Australia," SPE 50081 MS, Oct. 1998, 12 pages.
Upchurch et al., "Relief Well Challenges and Solutions for Subsea Big-Bore Field Developments," SPE 199550, SPE Drilling & Completion, 2020, 35(04):588-597, 10 pages.

* cited by examiner

PRODUCING GAS THROUGH VARIABLE BORE PRODUCTION TUBING

TECHNICAL FIELD

This disclosure relates to hydrocarbon gas production.

BACKGROUND

Production of hydrocarbon gasses involves forming a wellbore into a geologic formation, and inserting production tubing into the wellbore to a production zone. The production tubing directs the hydrocarbons from the geologic formation towards a topside facility located on a terranean surface. Production tubing often has a monobore or tapered (two section) design. A monobore design includes a same inner diameter from the production zone to the topside facility. Such tubing can be constructed in sections in the field, or can be fabricated offsite and be inserted into the wellbore from spools. Tapered designs include a downhole section coupled to an uphole section. The uphole section has a diameter greater than the downhole section, and the sections are arranged coaxially with an uphole end of the downhole section extending partially into a downhole end of the uphole section.

SUMMARY

This disclosure describes technologies relating to producing gas through variable bore production tubing.

An example of the subject matter described within this disclosure is a prefabricated production tubing string with the following features. An uphole section has a first diameter. A midhole section has a second diameter that is larger than the first diameter. The midhole section is attached to the uphole section prior to installation into a wellbore. A downhole section has a third diameter that is smaller than the second diameter. The downhole section is attached to the midhole section prior to installation into the wellbore.

Aspects of the example prefabricated production tubing string, which can be combined with the example prefabricated production tubing string alone or in combination with other aspects, include the following. The first diameter and the third diameter are substantially equal.

Aspects of the example prefabricated production tubing string, which can be combined with the example prefabricated production tubing string alone or in combination with other aspects, include the following. The first diameter is greater than the third diameter.

Aspects of the example prefabricated production tubing string, which can be combined with the example prefabricated production tubing string alone or in combination with other aspects, include the following. A first transition is between the uphole section and the midhole section. The first transition includes a first end coupled to the uphole section and a second end coupled to the midhole section. The first end has a diameter substantially the same as the uphole section and the second end having a diameter substantially the same as the midhole section. A second transition is between the midhole section and the downhole section. The transition includes a first end coupled to the midhole section and a second end coupled to the downhole section. The first end has a diameter substantially the same as the midhole section. The second end has a diameter substantially similar to the downhole section.

Aspects of the example prefabricated production tubing string, which can be combined with the example prefabricated production tubing string alone or in combination with other aspects, include the following. The first transition and the second transition include a corrosion or erosion resistant alloy.

Aspects of the example prefabricated production tubing string, which can be combined with the example prefabricated production tubing string alone or in combination with other aspects, include the following. The uphole section is substantially 10% of a total length of the tubing string.

Aspects of the example prefabricated production tubing string, which can be combined with the example prefabricated production tubing string alone or in combination with other aspects, include the following. The midhole section is substantially 75% of a total length of the tubing string.

Aspects of the example prefabricated production tubing string, which can be combined with the example prefabricated production tubing string alone or in combination with other aspects, include the following. The downhole section is substantially 15% of a total length of the tubing string.

An example of the subject matter described within this disclosure is a method with the following features. Gas is produced through production tubing. The production tubing includes an uphole section having a first diameter. A midhole section has a second diameter that is larger than the first diameter. A downhole section has a third diameter that is smaller than the second diameter.

Aspects of the example method, which can be combined with the example method alone or in combination with other aspects, include the following. A production rate of the gas exceeds 300 million standard cubic feet of gas per day.

Aspects of the example method, which can be combined with the example method alone or in combination with other aspects, include the following. A pressure of the production gas exceeds 10,000 pounds per square inch.

Aspects of the example method, which can be combined with the example method alone or in combination with other aspects, include the following. The production gas comprises sour production gas.

An example of the subject matter described within this disclosure is a production system with the following features. A production string is within the wellbore. The production string includes an uphole section having a first diameter. A midhole section has a second diameter that is larger than the first diameter. A downhole section has a third diameter that is smaller than the second diameter.

Aspects of the example production system, which can be combined with the example production system alone or in combination with other aspects, include the following. The wellbore is a deviated or horizontal wellbore.

Aspects of the example production system, which can be combined with the example production system alone or in combination with other aspects, include the following. The first diameter and the third diameter are substantially equal.

Aspects of the example production system, which can be combined with the example production system alone or in combination with other aspects, include the following. The first diameter is less than the third diameter.

Aspects of the example production system, which can be combined with the example production system alone or in combination with other aspects, include the following. A first transition is between the uphole section and the midhole section. The first transition includes a first end coupled to the uphole section and a second end coupled to the midhole section. The first end has a diameter substantially the same as the uphole section and the second end has a diameter substantially the same as the midhole section. A second transition is between the midhole section and the downhole section. The transition includes a first end coupled to the midhole section and a second end coupled to the downhole section. The first end has a diameter substantially the same as the midhole section. The second end has a diameter substantially similar to the downhole section.

Aspects of the example production system, which can be combined with the example production system alone or in combination with other aspects, include the following. The first transition and the second transition include a corrosion or erosion resistant alloy.

Aspects of the example production system, which can be combined with the example production system alone or in combination with other aspects, include the following. The uphole section is substantially 10% of a total length of the production string.

Aspects of the example production system, which can be combined with the example production system alone or in combination with other aspects, include the following. The midhole section is substantially 75% of a total length of the production string.

Aspects of the example production system, which can be combined with the example production system alone or in combination with other aspects, include the following. The downhole section is substantially 15% of a total length of the production string.

Particular implementations of the subject matter described in this disclosure can be implemented so as to realize one or more of the following advantages. The concepts described herein allow for resilient, high-flow, high-pressure sour or sweet gas production.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to production tubing capable of producing ultra-high rate, sour gas with lower erosion in high-pressure, high-temperature, sour carbonate or clastic reservoirs when compared to conventional production tubing. The resulting production tubing has three varying diameter sections, an uphole section with length determined by a combination of hydrate and erosion risk tendency, a midhole section with length determined by optimal production rate and installation requirements, and a downhole section determined by mechanical strength required to ensure production for a given reservoir condition. The ultra-high rate wells are classed as wells with a production rate above 300 million standard cubic feet per day.

Figure 1:
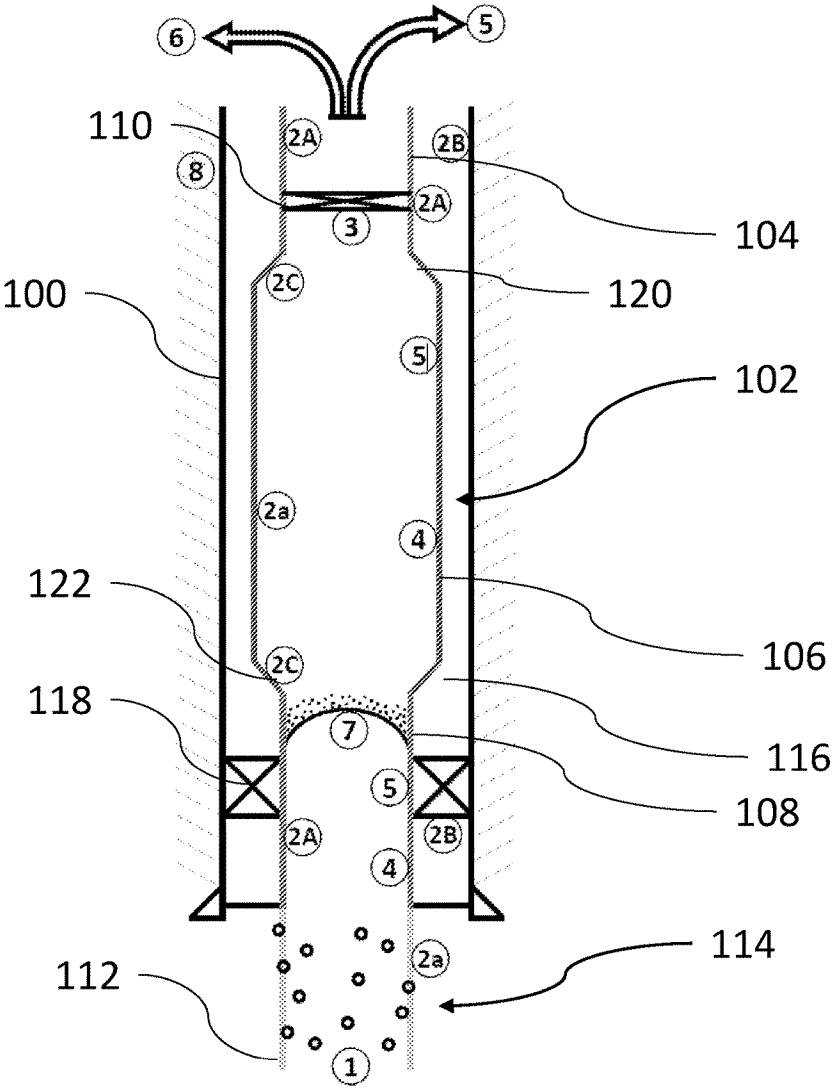
FIG. 1 is a schematic view of an example production wellbore with production tubing.

FIG. 1 is a schematic view of an example production wellbore 100 with production tubing 102 installed. In some implementations, the production tubing is designed and fabricated prior to being installed within the wellbore. That is, the production tubing can be produced and built off-site or on-site, but is fully constructed to a substantially full length (for example, 90%) prior to installation. The prefabricated tubing string includes three sections: an uphole section 104, a midhole section 106, and a downhole section 108. The uphole section 104 has a first diameter. The midhole section 106 is attached to a downhole end of the uphole section 104 prior to the production tubing's installation into the wellbore 100. The midhole section 106 has a diameter that is larger than the diameter of the uphole section 104. The downhole section 108 has a third diameter that is smaller than the second diameter. The downhole section 108 is attached to the midhole section 106 prior to installation into the wellbore 100. While the illustrated implementation shows the production tubing 102 installed within a vertical wellbore, the concepts described herein are similarly applicable to deviated and horizontal wellbores.

At an uphole end of the production tubing 102 is a subsurface valve 110. The subsurface valve 110 is used to control the wellbore 100, more specifically, to shut-in the wellbore. In some implementations, the subsurface valve 110 is controlled from a topside facility (not shown). The subsurface valve 110 is made of materials suited for the wellbore environment. In some implementations, the subsurface valve 110 is made of a corrosion or erosion resistant alloy. For example, in implementations with sour gas production, a national Association of Corrosion Engineers (NACE) certified (or similar) valve is used. In some implementations, the bore size of the subsurface valve 110 is determined by iterative flow assurance models.

At a downhole end of the production tubing 102 is a production zone 112. The production zone 112 is fluidically connected to an inner bore of the production tubing 102 by perforations 114. An annulus 116, defined by an outer surface of the production tubing 102 and an inner surface of the wellbore 100, is isolated from production fluids by a packer 118. While illustrated with a single packer 118, multiple packers can be used without departing from this disclosure. In some implementations, additional wellbore components, such as a hanger, can be used in addition to the concepts described herein without departing from this disclosure.

The geometry of each section is dependent upon design considerations such as flow-rate, pressure, and composition of the production stream. For example, in some implementations, the first diameter and the third diameter are substantially equal (within manufacturing tolerances). In some implementations, the first diameter is greater than the third diameter. In some implementations, the first diameter is less than the third diameter. Determining a diameter of one or more sections is done, in some instances, with iterative flow assurance models. In some implementations, the diameter of one or more sections is determined.

The length of each section is similarly dependent upon design considerations such as flow-rate, pressure, and composition of the production stream. Determining a length of each section is done, in some instances, with iterative flow assurance models.

Alternatively or in addition, a length of the uphole section 104 is determined by a combination of hydrate and erosion risk tendencies. Alternatively or in addition, a length of the midhole section 106 is determined by optimal production rate and installation requirements. Alternatively or in addition, a length of the downhole section 108 is determined by mechanical strength required to ensure production for a given reservoir condition. In some implementations, the uphole section 104 is substantially 10% of a total length of the production tubing 102 (plus or minus 5% of the total length of the 102). In some implementations, the midhole section 106 is substantially 75% of a total length of the production tubing 102 (plus or minus 10% of the total length of the production tubing 102). In some implementations, the downhole section 108 is substantially 15% of a total length of the production tubing 102 (plus or minus 10% of the total length of the production tubing 102).

Between each section is a transition. A first, upper transition 120 is between the uphole section 104 and the midhole section 106. The upper transition 120 includes a first end coupled to the uphole section 104 and a second end coupled to the midhole section 106. The first end of the upper transition 120 has a diameter substantially the same as the uphole section 104, and the second end of the upper transition 120 has a diameter substantially the same as the midhole section 106. A second, lower transition 122 is between the midhole section 106 and the downhole section 108. The lower transition 122 includes a first end coupled to the midhole section 106 and a second end coupled to the downhole section 108. The first end of the lower transition 122 has a diameter substantially the same as the midhole section 106, and the second end of the lower transition has a diameter substantially similar to the downhole section 108.

In some implementations, all or part of the production string is made of a corrosion or erosion resistant alloy. For example, in some implementations, the upper transition 120 and the lower transition 122 are made of an erosion resistant alloy as the reduction in flow diameter can result in particulate impacts upon the transition. In some implementations, such as with sweet (High $CO_2$ content) or sour (high $H_2S$ content) gasses are produced, an entirety of the string is made of a corrosion resistant alloy.

Figure 2:
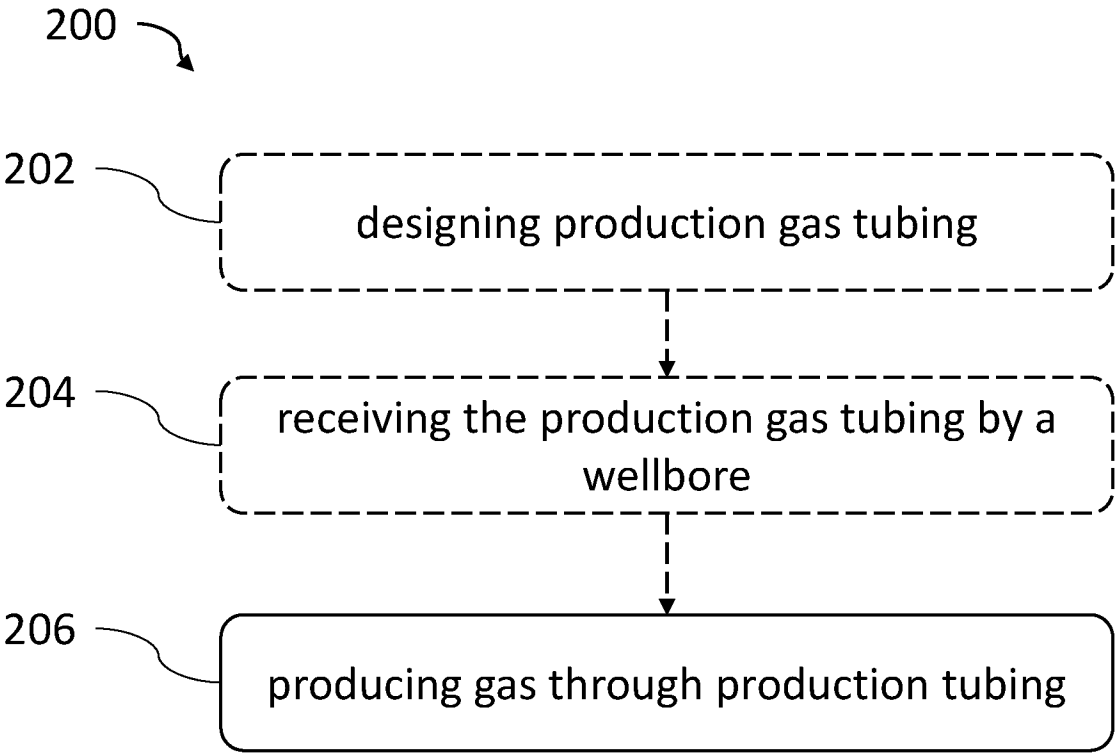
FIG. 2 is a flowchart of an example method that can be used with aspects of this disclosure.

FIG. 2 is a flowchart of an example method 200 that can be used with aspects of this disclosure. At 202, a string of production tubing 102 is designed with the three sections described throughout this disclosure. The production tubing 102 is constructed, and at 204, the production tubing is received by the wellbore 100. At 206, hydrocarbon gas is produced through production tubing. In some implementations, a production rate of the gas exceeds 300 million standard cubic feet of gas per day. In some implementations, the production gas has a pressure equal to or in excess of 10,000 pounds per square inch. In some implementations, the production gas includes sweet or sour production gas.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results Moreover, the separation of various system components in the implementations described above should not be understood as requiring such separation in all implementations, and it should be understood that the described components and systems can generally be integrated together in a single product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A prefabricated production tubing string comprising: an uphole section having a first diameter, the uphole section designed based on a combination of hydrate and erosion tendencies within a well in which the prefabricated production tubing string is to be installed;

a midhole section having a second diameter that is larger than the first diameter, the midhole section attached to the uphole section prior to installation into a well, the midhole section designed based on optimal production rate and installation requires of the well, wherein the midhole section is substantially 75% of a total length of the tubing string; and a downhole section having a third diameter that is smaller than the second diameter, the downhole section being attached to the midhole section prior to installation into the well, the downhole section designed based on mechanical strength of the well.

2. The production tubing string of claim 1, wherein the first diameter and the third diameter are substantially equal.

3. The production string of claim 1, wherein the first diameter is greater than the third diameter.

4. The production string of claim 1, further comprising:

a first transition between the uphole section and the midhole section, the first transition comprising a first end coupled to the uphole section and a second end coupled to the midhole section, the first end having a diameter substantially the same as the uphole section and the second end having a diameter substantially the same as the midhole section; and a second transition between the midhole section and the downhole section, the transition comprising a first end coupled to the midhole section and a second end coupled to the downhole section, the first end having a diameter substantially the same as the midhole section, the second end having a diameter substantially similar to the downhole section.

5. The production string of claim 4, wherein the first transition and the second transition comprise a corrosion or erosion resistant alloy.

6. The production string of claim 1, wherein the uphole section is substantially 10% of a total length of the tubing string.

7. The production string of claim 1, wherein the downhole section is substantially 15% of a total length of the tubing string.

8. A method comprising:

designing an uphole section of a production tubing string based on a combination of hydrate and erosion tendencies within a well in which the production tubing string is to be installed, the uphole section having a first diameter;

designing a midhole section of the production tubing string based on optimal production rate and installation requires of the well;

designing a downhole section of the production tubing string based on mechanical strength of the well;

fabricating the production string having the designed uphole section, the designed midhole section and the designed downhole section;

producing gas through the production tubing string, the production tubing string comprising:

the uphole section having the first diameter;

the midhole section having a second diameter that is larger than the first diameter; and the downhole section having a third diameter that is smaller than the second diameter.

9. The method of claim 8, wherein a production rate of the gas exceeds 300 million standard cubic feet of gas per day.

10. The method of claim 8, wherein a pressure of the production gas exceeds 10,000 pounds per square inch.

11. The method of claim 8, wherein the production gas comprises sour production gas.

12. A production system comprising:

a well;

a production string within the well, the production string comprising:

an uphole section having a first diameter, the uphole section designed based on a combination of hydrate and erosion tendencies within a well in which the prefabricated production tubing string is to be installed;

a midhole section having a second diameter that is larger than the first diameter, the midhole section designed based on optimal production rate and installation requires of the well, wherein the midhole section is substantially 75% of a total length of the production string; and a downhole section having a third diameter that is smaller than the second diameter, the downhole section designed based on mechanical strength of the well.

13. The production system of claim 12, wherein the well is a deviated or horizontal well.

14. The production system of claim 12, wherein the first diameter and the third diameter are substantially equal.

15. The production system of claim 12, wherein the first diameter is less than the third diameter.

16. The production system of claim 12, further comprising:

a first transition between the uphole section and the midhole section, the first transition comprising a first end coupled to the uphole section and a second end coupled to the midhole section, the first end having a diameter substantially the same as the uphole section and the second end having a diameter substantially the same as the midhole section; and a second transition between the midhole section and the downhole section, the transition comprising a first end coupled to the midhole section and a second end coupled to the downhole section, the first end having a diameter substantially the same as the midhole section, the second end having a diameter substantially similar to the downhole section.

17. The production system of claim 16, wherein the first transition and the second transition comprise a corrosion or erosion resistant alloy.

18. The production string of claim 16, wherein the uphole section is substantially 10% of a total length of the production string.

19. The production string of claim 16, wherein the downhole section is substantially 15% of a total length of the production string.

* * * * *